US005779612A

United States Patent [19]

Whitney

[11] Patent Number: 5,779,612

[45] Date of Patent: Jul. 14, 1998

[54] COMBINATION CHECK AND ENVELOPE

[76] Inventor: J. Garrett Whitney, 2225 Mistletoe Ave., Fort Worth, Tex. 76110

[21] Appl. No.: 752,632

[22] Filed: Nov. 19, 1996

Related U.S. Application Data

[63] Continuation of Ser. No. 317,316, Oct. 4, 1994, abandoned.

[51] Int. Cl.[6] ..... B31B 1/88

[52] U.S. Cl. ..... 493/331; 493/325; 493/405; 493/416; 493/216; 283/116; 283/57; 283/58

[58] Field of Search ..... 283/56–59, 67, 283/117, 116; 229/92.8; 493/325, 331, 356, 405, 416, 921, 216

[56] References Cited

U.S. PATENT DOCUMENTS

| | | | |
|---|---|---|---|
| 2,831,707 | 4/1958 | James, Jr. et al. . | |
| 2,835,512 | 5/1958 | Whitman . | |
| 2,887,326 | 5/1959 | Kramer . | |
| 2,985,464 | 5/1961 | McFarland . | |
| 3,790,193 | 2/1974 | McBride | 283/57 |
| 4,585,160 | 4/1986 | Fiske II . | |
| 4,668,211 | 5/1987 | Lubotta et al. | 493/216 X |
| 4,860,945 | 8/1989 | Breen | 493/216 X |
| 4,951,864 | 8/1990 | Dicker . | |
| 5,062,570 | 11/1991 | Ashby . | |
| 5,121,945 | 6/1992 | Thomson et al. | 283/58 |
| 5,290,225 | 3/1994 | Younger | 493/921 X |

OTHER PUBLICATIONS

Young American Corporation, Combination Check/Envelope Form.

Troy Z–fold type envelope and check.

Xerox C–fold type envelope and check.

*Primary Examiner*—Frances Han

*Attorney, Agent, or Firm*—James E. Bradley

[57] ABSTRACT

A method of writing a bank draft using an electronic printer and placing the bank draft in an envelope is accomplished by providing a single sheet of paper. The sheet of paper is completely opaque and sized to be received within the electronic printer. The paper sheet has a front surface and a back surface and a perimeter which is defined by opposite side and end edges. A line of perforations extend between the opposite side edges and divide the paper sheet into an envelope portion and a bank draft portion. The paper sheet is fed into the electronic printer where recipient indicia is printed on the envelope portion and bank draft indicia is printed on the bank draft portion. The paper sheet is then discharged from the electronic printer and folded so that the envelope portion forms an envelope for the bank draft.

8 Claims, 4 Drawing Sheets

COMBINATION CHECK AND ENVELOPE

This is a continuation of application Ser. No. 08/317,316, filed Oct. 4, 1994, now abandoned.

BACKGROUND OF THE INVENTION

1. Field of the Invention

This invention relates to a method of writing a bank draft using an electronic printer and placing the bank draft in an envelope.

2. Description of the Prior Art

Businesses and individual households typically make payments for bills and other accounts payable, through the use of a check, bank draft or other negotiable paper, all of which will be referred to herein as "bank draft" for convenience. In order for the payment instrument to be of any use or value it must be filled out with the necessary information, indicating the amount of the payment and the recipient. This information is placed on the paper either by hand or through use of some printing means. The executed instrument is often placed in an envelope for delivery to the recipient or for the paper's concealment. The information pertaining to the check is usually recorded by the payor so that they have a record of the details of the transaction, such as when the payment was made, how much it was for, and to whom it was paid. Oftentimes individual businesses and households are required to execute numerous checks during any given time period. The large number of checks that must be filled out makes it both laborsome and time consuming to fill out the checks by hand. In addition, for each check, an envelope must be appropriately labeled to identify the recipient of the check.

Computers have made many of the above tasks more simple. For instance, blank checks can now be printed with the appropriate information using an electronic printer attached to a computer which stores the necessary information to be placed on the check. Envelopes can also be printed in a similar manner. This allows large numbers of checks or envelopes to be printed easily and quickly. The checks and envelopes, however, must each be printed separately from the other due to differences in size and the physical placement of the information on the check or envelope. Once the envelopes and checks are appropriately filled out, they then must be sorted so that they correspond to one another.

What is needed is a method and instrument for providing a bank draft and envelope for its delivery which can be formed from the same sheet of paper and which can be used in an electronic printer so that the bank draft and envelope are each printed at the same time and which associates the check with an appropriately addressed envelope for its delivery.

SUMMARY OF THE INVENTION

A method of writing a bank draft using an electronic printer and placing the bank draft in an envelope is accomplished by providing a single sheet of paper. The sheet of paper is completely opaque and sized to be received within the electronic printer. The paper sheet has a front surface and a back surface and a perimeter which is defined by opposite side and end edges. A line of perforations which extends between the opposite side edges divides the paper sheet into an envelope portion and a bank draft portion.

The paper sheet is fed into the electronic printer where recipient indicia is printed on the front surface of the envelope portion and bank draft indicia is printed on the front surface of the bank draft portion. The paper sheet is then discharged from the electronic printer and folded substantially along the line of perforations. The envelope portion is likewise folded about a transverse line so that the envelope is divided into upper and lower sections with one of the end edges being located on one of the upper and lower sections to form a flap. The bank draft portion locating between the back surface of the upper and lower sections when the envelope portion is folded about the transverse line.

The side edges of the upper and lower sections of the envelope portion are bonded together so that the upper and lower sections are held in an envelope configuration. The flap is folded over the other of the upper and lower sections so that the envelope portion is effectively enclosed within the envelope portion.

DETAILED DESCRIPTION OF THE PREFERRED EMBODIMENT

Figure 1:
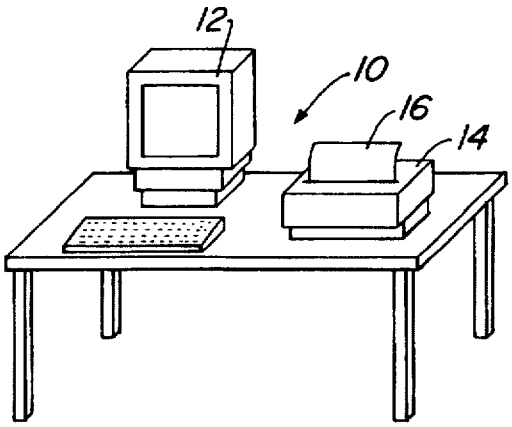
FIG. 1 is a schematic view of a computer system having an electronic printer used in carrying out the method of the invention.

FIG. 1 shows a personal computer system 10 comprised of a personal computer 12 with an electronic printer 14 attached. A bank draft instrument 16 is provided with the printer 14 and is constructed in accordance with the description which is to follow. It is anticipated that the instrument 16 would be used in combination with a personal or business computer 12 which is supplied with appropriate business or accounting software to carry out the method of the invention. Primarily the instrument 16 would be used in the home or business setting.

Figure 2:
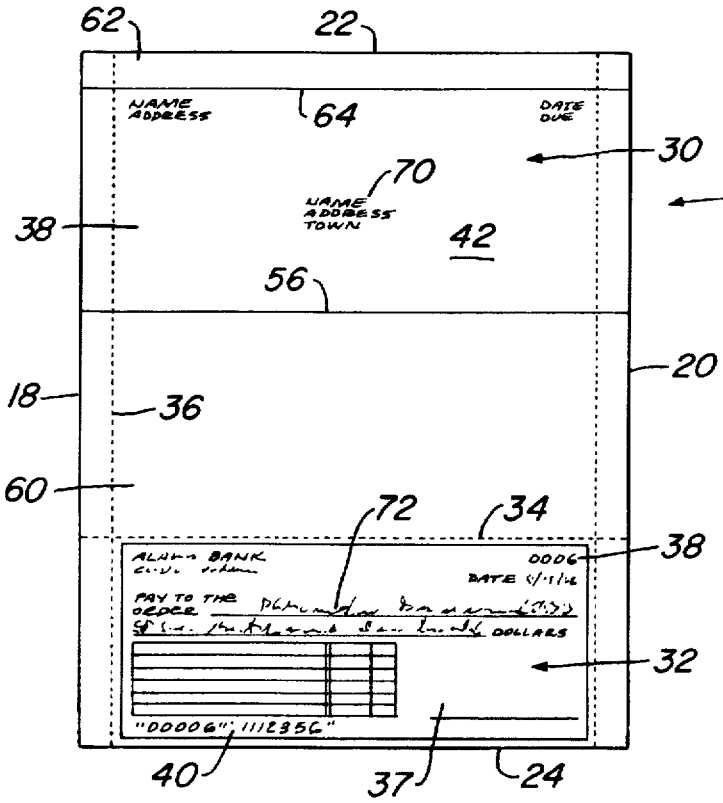
FIG. 2 is a front view of an instrument constructed in accordance with the invention.

Referring to FIG. 2, the instrument 16 is constructed of a single sheet of paper material. The sheet 16 is completely opaque, and as seen in FIG. 2, is rectangular in shape and has a perimeter defined by left and right side edges 18, 20 and top and bottom end edges 22, 24 which are perpendicular to the side edges 18, 20. The dimensions of the sheet 16 may vary without departing with the scope of the invention, however, the paper 16 should be sized so that it can be used with conventional electronic printers, such as the 8½ by 11 inch letter sized paper.

The instrument 16 is divided into an upper envelope portion 30 and a lower bank draft portion 32 by a transverse line of perforations 34 which extend between side edges 18, 20. The perforations 34 allow the bank draft portion 32 to be removed from the envelope portion 30 of the sheet 16. Located adjacent to the side edges 18, 20 are longitudinal perforations 36 which allow the side edges 18, 20 to be removed from the paper sheet 16. The bank draft 37 itself is located between the longitudinal perforations 36 on the bank draft portion 32 of the instrument 16. The perforations 34, 36 are preferably preformed in the sheet 16.

The bank draft 37 of the instrument 16 may be completely free of printing except for a check number 38 and corresponding account code information 40 which are preprinted on a front surface 42 of the instrument 16. The account code 40 is typically printed on the bank draft 37 with magnetic ink to allow the bank draft 37 to be electronically identified with a particular bank account of the user using automated means. It is within the scope of this invention, however, that the account code information 40 could also be printed on the instrument 16 in accordance with the method of the invention by means of a suitable printer which is capable of printing these indicia using magnetic ink with the check number 38 being printed to correspond to the account information 40. Other information could also be preprinted on the bank draft 37 which would be previously known to the user and would not vary from instrument to instrument. Thus, for example, the bank address and identity could be preprinted on the check along with the name and address of the user. Date, amount and signature lines could also be preprinted on the front surface 42 of the bank draft 37.

Figure 3:
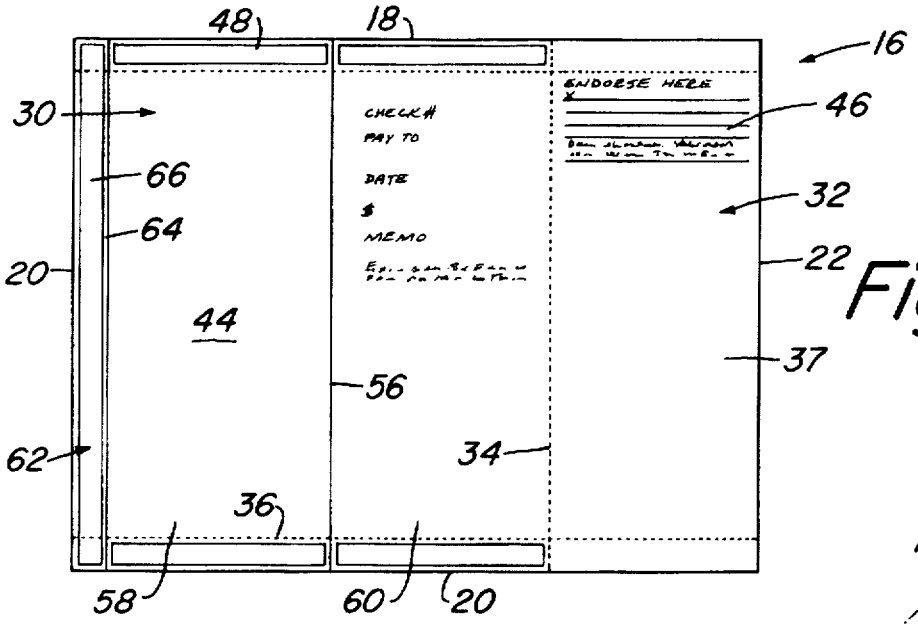
FIG. 3 is back view of the instrument of FIG. 2.

FIG. 3 shows the back surface 44 of the instrument 16. The back surface 44 of the bank draft 37 is preprinted, as well, with conventional endorsement indicia 46. Preformed longitudinal glue strips 48 are located on the back surface 44 of the envelope portion 30 along the side edges 18, 20 outwardly adjacent to the longitudinal perforations 36. Each glue strip 48 is formed from a layer of adhesive which is activated by the application of moisture, such as water or saliva. These adhesives are commonly used with envelopes and the like, however, other suitable adhesives could also be used which are well known to those skilled in the art.

The envelope portion 30 of the instrument 16 is further divided by a transverse fold line 56 which extends between either side edge 18, 20. The fold line 56 divides the envelope portion into an upper section 58 and a lower section 60. The upper section 58 has a longitudinal width that is slightly greater than that of the lower section 60. This allows a transverse end flap 62, incorporating the end edge 22, to be formed on the upper section 58 by a second transverse fold line 64. The fold line 64 is located adjacent and parallel to the end edge 22 and extends between the side edges 18, 20. The back surface 60 of the flap 62 is also provided with a transverse glue strip 66 similar to the glue strips 48. Both the upper and lower sections 58, 60 have a longitudinal width that is greater than that of the bank draft portion 32.

To use the instrument 16, a plurality of instrument forms 16 are loaded into a printer, such as the electronic printer 14, of the computer system 10 in a conventional manner. The instrument forms 16 should be oriented so that the front surface 42 of the instrument 16 receives the printing from the electronic printer 14 and the characters are printed upright on the face of the instrument 16. Although not shown in the Figures, the instrument 16 may be provided as continuous printer paper which is perforated for separating each instrument 16 for use with a tractor or pin-type feed printer and provided with suitable engagement means removeably attached to the left and right side edges 18, 20 of each bank draft instrument 16.

It is anticipated that the instrument 16 would be used along with a personal computer 12 which is provided with a program or software which enables the printer 14 to fill out and complete the forms 16 as described herein. In printing the instrument 16, with the electronic printer 14, envelope indicia 70 are printed on the front surface 42 of the upper section 58 of the envelope portion 30. The envelope indicia 70 may include such things as the name and address of the recipient, the user's return address, and the due date of the payment if the bank draft 37 is intended to be delivered by a certain date. Bank draft indicia 72 are also printed on the front surface of the bank draft 37. This indicia 72 includes the amount of the check or bank draft, the date, the name of the recipient as well as other information necessary for properly executing the bank draft. Both the envelope portion 30 and the bank draft portion 32 are printed substantially simultaneously without removing the instrument 16 from the printer 14.

Figure 4:
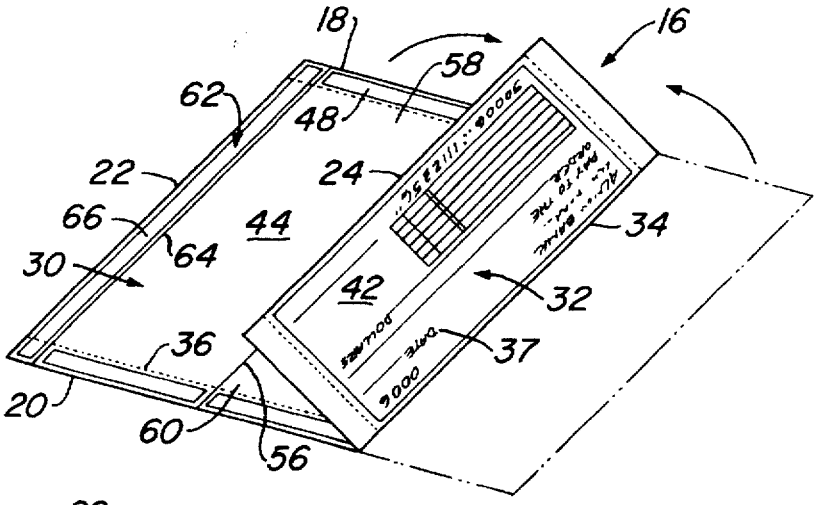
FIG. 4 is a perspective view of the instrument of FIG. 2 showing a bank draft portion being folded over an envelope portion of the instrument in accordance with the invention.

Once the bank draft instrument 16 has been printed by means of the printer 14, the instrument 16 is removed from the printer 14. The user would then sign or otherwise execute the bank draft 37. The bank draft portion 42 is then folded along the transverse line of perforations 34 or slightly above the line of perforations 34, as shown in FIG. 4, so that the back surface 44 of the bank draft portion 32 faces the back surface 44 of the lower section 60 of the envelope portion 30. The glue strips 48 located on the lower section 60 of the envelope 30 are moistened to promote the adhesion of the side edges 18, 20 of the bank draft portion 32 to the side edges 18, 20 of the lower section 60 of the envelope 30. Next, the upper section 58 is folded along the transverse line 56 with the glue strips 48 on the upper section 58 also being moistened or made tacky to adhere to the front surface 42 of the side edges 18, 20 of the bank draft portion 32. This causes the instrument 16 to have a substantially envelope shaped configuration. Because the upper and lower sections 58, 60 of the envelope portion 30 each have a longitudinal width that is greater than that of the bank draft portion 32, the bank draft 37 is completely covered between the upper and lower sections 58, 60 of the envelope portion 30.

The glue strip 66 on the end flap 62 of the upper section 58 is then moistened and the flap 62 is folded along the transverse fold line 56 so that the glue strip 66 contacts and is bonded to the outer surface 42 of the lower section 60. This effectively seals the bank draft 37 between the upper and lower sections 58, 60 for concealment of the bank draft and delivery to the recipient. The envelope indicia 70 on the upper section 58 allows the user to see who the recipient of the envelope is, and if there is a due date, allows the user to see when it must be mailed.

Figure 5:
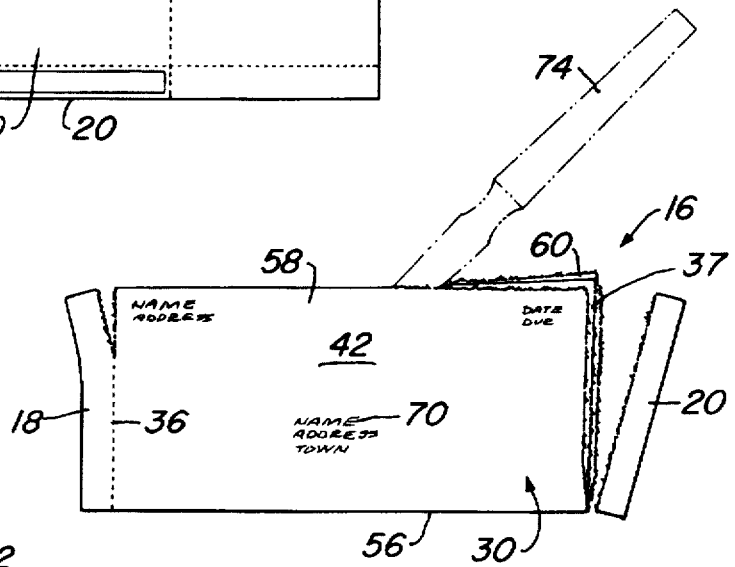
FIG. 5 is a front view of the instrument of FIG. 2 after the instrument has been formed into an envelope and showing the envelope being opened.
Figure 6:
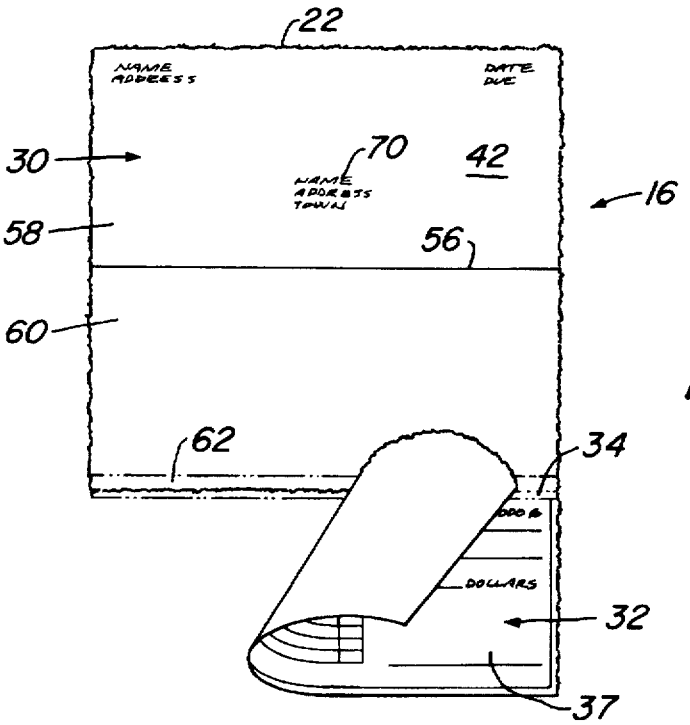
FIG. 6 is front view of the instrument of FIG. 5 after the envelope has been opened and showing the bank draft of the envelope being removed.

To remove the bank draft 37 from the envelope 30, the left and right side edges 18, 20 are removed by separating them from the remainder of the bank draft instrument 16 along the longitudinal perforations 36, as shown in FIG. 5. A letter opener 74 or other device is then used to separate the end flap 62 from the remainder of the upper section 58 of the envelope 30 along the transverse fold line 64 so that the instrument 16 can be opened and unfolded with the separated flap 62 adhering to the lower section 60 as shown in FIG. 6. Alternatively, if the adhesive strip 66 does not form a permanent bond with the outer surface 42 of the lower section 60, the bond can be broken and the flap 62 can be merely lifted from the lower section 60 so that the envelope 30 opens. The check or bank draft 37 is then separated from the envelope portion 30 along the transverse line of perforations 34.

Figure 7:
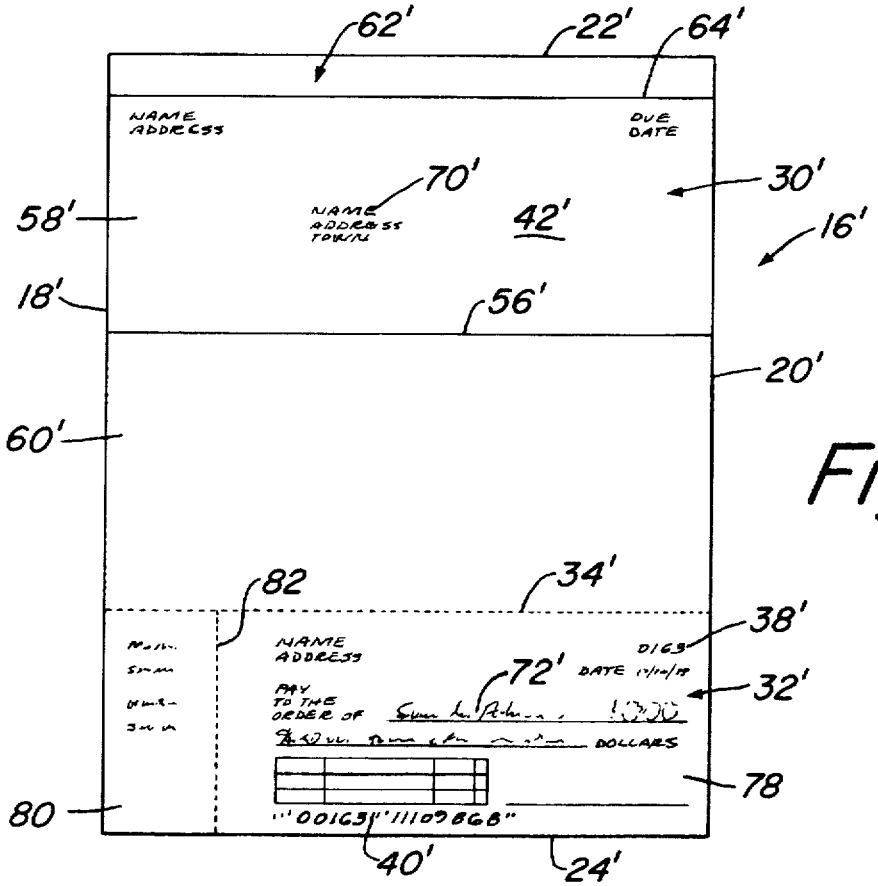
FIG. 7 is a front view of another embodiment of the instrument constructed in accordance with the invention.

FIGS. 7 through 10 show a bank draft instrument 16' which is constructed similarly to that shown in FIG. 1–6 with similar components designated by a prime symbol. Referring to FIG. 7, instrument 16' is comprised of an envelope portion 30' and a bank draft portion 32' which are created by a transverse line of perforations 34 which extend between left and right side edges 18', 20'. The instrument 16', however, does not have longitudinal perforations along the side edges 18', 20'. The bank draft portion 32' is divided into a check or bank draft 78 and a check stub 80 which are separated by a longitudinal line of perforations 82.

Figure 8:
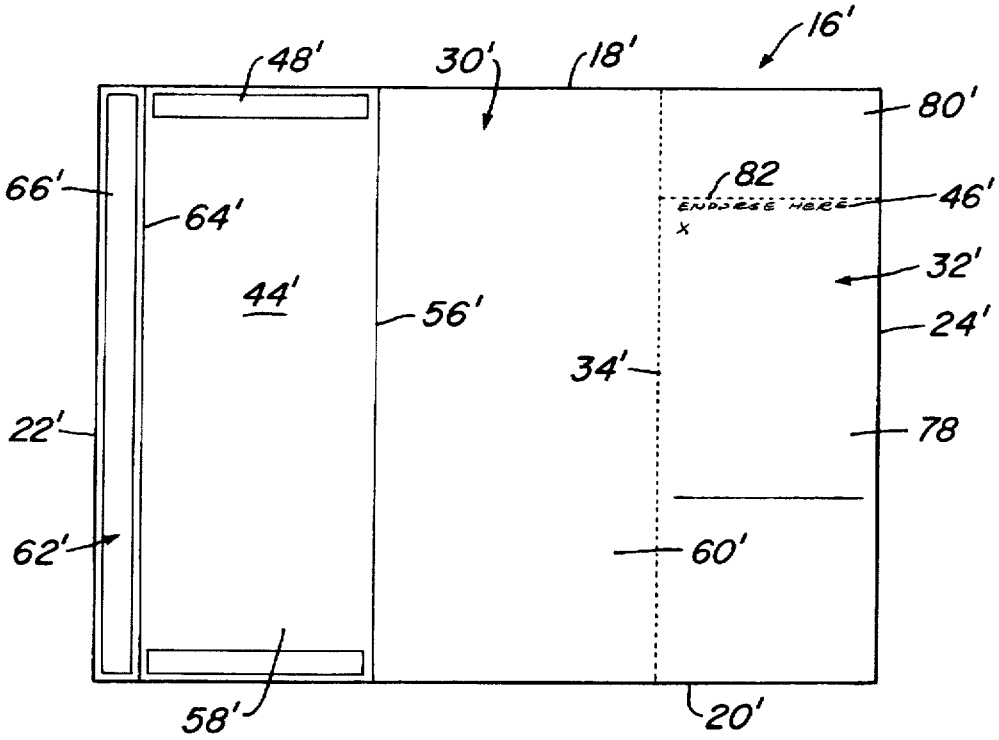
FIG. 8 is a back view of the instrument of FIG. 7.

FIG. 8 shows the back surface 44' of the bank draft instrument 16'. The glue strips 48' are located only on the back surface 44 of the upper section 58 of the envelope 30' along the left and right side edges 18', 20'. The glue strips 48' are spaced apart a distance greater than the transverse width of the bank draft 78. A transverse glue strip 66' is also provided on the flap 62' of the upper section 58'.

In printing the bank draft instrument 16', the instrument 16' is fed and printed in substantially the same manner as that described for the bank draft instrument 16. Suitable bank draft indicia 72' are printed on the check or bank draft 78 and envelope indicia 70' are printed on the upper section 58 of the envelope portion 30'. In addition, information may be printed on the front surface 42' of the check stub 80, which may include such items as the identity of the recipient and the amount of the check or bank draft and the date the check 78 was written. Again, the envelope portion 30', the bank draft 78 and the record stub 80 are printed at substantially the same time without removing the instrument 16' from the printer.

Figure 9:
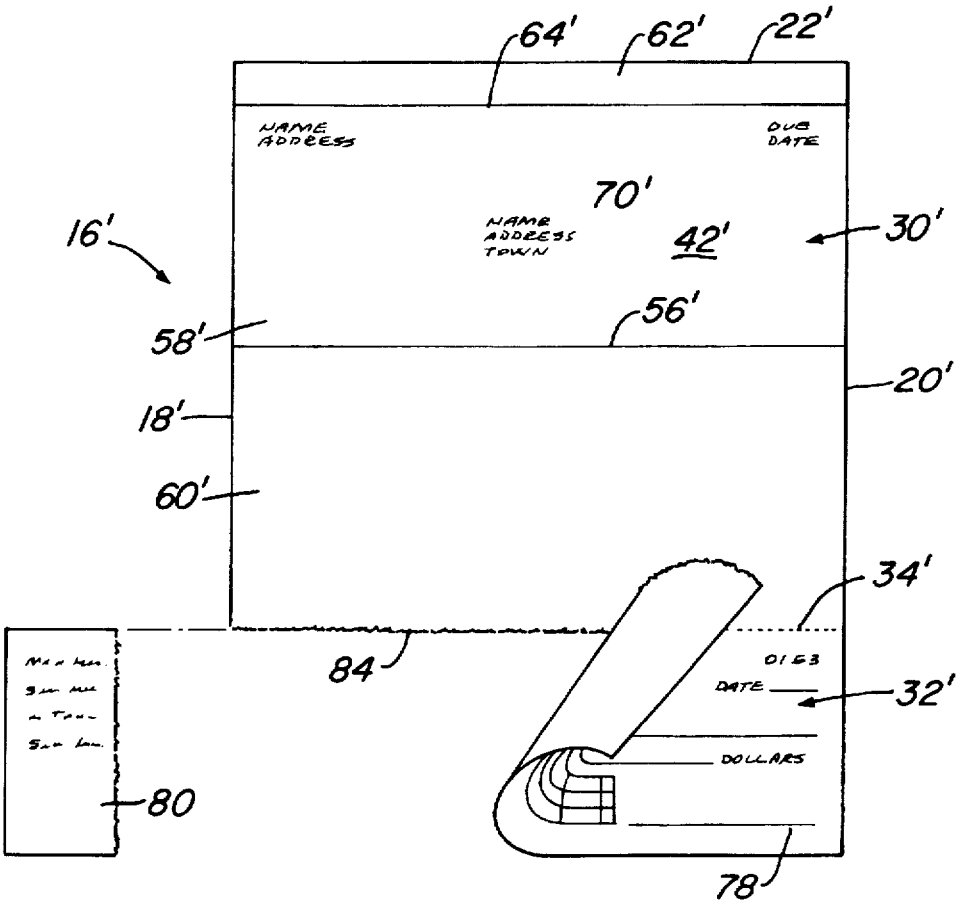
FIG. 9 is a front view of the instrument of FIG. 7 showing a bank draft portion of the instrument being removed.
Figure 10:
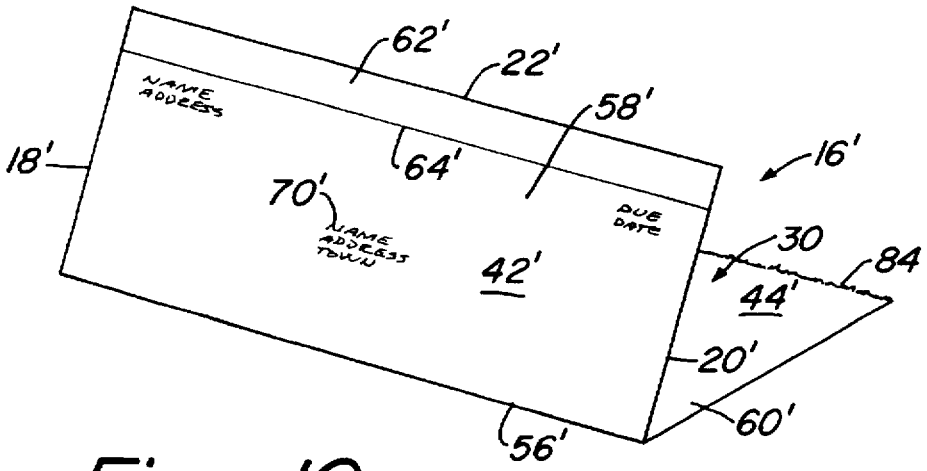
FIG. 10 is a perspective view of the instrument of FIG. 7 showing an envelope portion being folded in accordance with the invention.

Once the bank draft instrument 16' has been printed and executed, the check stub 80 and check 78 are removed from the remainder of the bank draft instrument 16' along the transverse line of perforations 34', as shown in FIG. 9. The removal of the bank draft portion 32' creates a lower edge 84 on the lower section 60'. The check stub 80 is also separated from the bank draft 78 along the perforations 82. The envelope portion 30 of the instrument 16 is then folded about the transverse fold line 56' (FIG. 10) with the lower edge 84 of the lower section 60' aligning substantially with the transverse fold line 64'. The glue strips 48' bond the upper section 58' to the back surface 44' of the lower section 60' along the side edges 18', 20' so that an envelope configuration is formed. The check 78 is then inserted through the opening located between the end edge 22' of the upper section 58' and the lower edge 84 of the lower section 60' and between the bonded upper and lower sections 58', 60'. The flap 62' is then folded over the opening and the lower edge 84 and secured to the outer surface 42' of lower section 60' by means of the glue strip 66'. The check stub 80 may be retained by the user for his own records, while the envelope containing the check 78 may be mailed or delivered to the recipient. The envelope 32' formed by the upper and lower sections 58', 60' are opened in a conventional manner.

The invention has several advantages over the prior art. Because the envelope and bank draft are formed on a single form or instrument, the envelope and bank draft can be printed simultaneously using an electronic printer in essentially one step. The paper used is sized so that it can be easily used in a conventional printer without modifications. Because the envelope is formed from the instrument itself, there is no need for envelopes to be printed separately and correlated with the appropriate bank draft. The printing is only on one side, allowing the printing step to be accomplished in a single pass using a conventional desk top printer.

While the invention has been shown in only two of its forms, it should be apparent to those skilled in the art that it is not so limited by is susceptible to various changes without departing from the scope of the invention. For example, this method can be used with 8½"×14" paper, in which case an extra panel can be used as a voucher or for other explanatory information.

I claim:

1. A method of writing and preparing to send a bank draft using an electronic printer such as those used in conjunction with a personal computer, the method comprising the steps of:

(a) providing a preglued, perforated paper sheet which is completely opaque and is sized to be received within the electronic printer, the paper sheet having a front surface and a back surface and having a perimeter defined by opposite side edges and upper and lower end edges, the paper sheet having an upper fold line parallel and adjacent to the upper end edge to define a flap, an intermediate fold line parallel to and spaced below the upper fold line to define an address panel between the intermediate and upper fold lines, a perforated line below and parallel to the intermediate fold line to define a central panel between the perforated line and the intermediate line and a bank draft panel below the perforated line, the paper sheet further being preglued with longitudinal adhesive stripe on the side edges of the back surfaces of the address panel and the central panel and with a transverse adhesive strip along the back surface of the flap; then (b) feeding the preglued, perforated paper sheet into the electronic printer;

(c) printing recipient indicia on the front surface of the address panel and the amount of the bank draft and recipient indicia on the front surface of the bank draft panel using the electronic printer; then (d) discharging the paper sheet from the electronic printer; then (e) folding the address panel along the intermediate fold line and the bank draft panel along the perforated line to define an envelope configuration with the bank draft panel sandwiched between the address panel and, central panel;

(f) bonding the adhesive strips on the back surface of the central panel and the address panel to seal the side edges of the address and central panels to retain the envelope configuration;

(g) folding tho flap over the back surface of the central panel; and (h) bonding the adhesive strip on the back surface of the flap to the front surface of the central panel, sealing the bank draft panel within the envelope configuration.

2. The method according to claim 1, wherein step (a) further comprises providing the paper sheet with a preprinted bank account number and bank name on the front surface of the bank draft panel.

3. The method according to claim 1, wherein step (a) further comprises providing the paper sheet with longitudinal perforations along both side edges so that the side edges may be removed when opening the envelope configuration to remove the bank draft.

4. The method according to claim 1, wherein step (a) further comprises providing the paper sheet with a longitudinal perforated line in the bank draft panel to define a bank draft stub; and step (c) further comprises printing the stub with at least a name of the recipient and an amount of the bank draft; and step (e) further comprises:

separating the stub from the bank draft panel along the longitudinal perforated line prior to sandwiching the bank draft panel between the address and central panels.

5. A method of writing and preparing to send a bank draft to pay an invoice using an electronic printer such as those used in conjunction with a personal computer, the method comprising the steps of:

(a) providing a preglued, perforated paper sheet which is completely opaque and is sized to be received within the electronic printer, the paper sheet having a front surface and a back surface and having a perimeter defined by opposite side edges and upper and lower end edges, the paper sheet having an upper fold line parallel and adjacent to the upper end edge to define a flap, an intermediate fold line parallel to and spaced below the upper fold line to define an address panel between the intermediate and upper fold lines, a perforated line below and parallel to the intermediate fold line to define a central panel between the perforated line and the intermediate line and a bank draft panel below the perforated line, the paper sheet further being preglued with longitudinal adhesive stripe on the side edges of the back surfaces of the address panel and the central panel and with a transverse adhesive strip along the back surface of the flap; then (b) feeding the preglued, perforated paper sheet into the electronic printer;

(c) printing recipient indicia on the front surface of the address panel and the amount of the bank draft and recipient indicia on the front surface of the bank draft panel using the electronic printer; then (d) discharging the paper sheet from the electronic printer; then (e) folding the address panel along the intermediate fold line and the bank draft panel along the perforated line to define an envelope configuration with the bank draft panel sandwiched between the address panel and central panel;

(f) bonding the adhesive strips on the back surface of the central panel to the back surface of the bank draft panel and bonding the adhesive strips on the back surface of the address panel to the front surface of the bank draft panel to seal the side edges of the address and central panels to retain the envelope configuration;

(g) inserting an invoice voucher into the envelope configuration; then (h) folding the flap over the back surface of the central panel; and (i) bonding the adhesive strip on the back surface of the flap to the front surface of the central panel, sealing the bank draft panel and the voucher within the envelope configuration.

6. The method according to claim 5, wherein step (a) further comprises providing the paper sheet with a preprinted bank account number and bank name on the front surface of the bank draft panel.

7. The method according to claim 5, wherein step (a) further comprises providing the paper sheet with longitudinal perforations along both side edges so that the side edges may be removed when opening the envelope configuration to remove the bank draft.

8. An instrument which can be written on with an electronic printer such as those used with personal computers which provides a bank draft and envelope, the instrument comprising:

a single paper sheet which is completely opaque and sized to be received within the electronic printer, the paper sheet having a front surface and a back surface and having a perimeter defined by opposite side and end edges;

a preformed upper fold line parallel and adjacent to the upper end edge to define a flap;

a preformed intermediate fold line parallel to and spaced below the upper fold line to define an address panel between the intermediate and upper fold lines;

a preformed perforated line below and parallel to the intermediate fold line to define a central panel between the perforated line and the intermediate line and a bank draft panel below the perforated line;

the front surface of the bank draft panel having preprinted thereon bank draft indicia including a bank name and bank account number;

the front surfaces of the address panel and the bank draft panel being capable of being printed thereon by the electronic printer to provide recipient indicia and the amount of the bank draft;

the address panel being foldable along the intermediate fold line and the bank draft panel being foldable along the perforated line to define an envelope configuration with the bank draft panel sandwiched between the address panel and central panel;

longitudinal adhesive stripe on the back surfaces of the central panel and the address panel along the side edges of the paper sheet for sealing the side edges of the address and central panels to retain the envelope configuration;

the flap being foldable over the back surface of the central panel; and a transverse adhesive strip on the back surface of the flap for scaling to the front surface of the central panel, sealing the bank draft panel within the envelope configuration.

* * * * *